US006827590B2

(12) United States Patent
Huss, Jr. et al.

(10) Patent No.: US 6,827,590 B2
(45) Date of Patent: Dec. 7, 2004

(54) SEALED ELECTRICAL CONNECTOR FOR RIGHT ANGLE CONTACTS

(75) Inventors: John Phillip Huss, Jr., Harrisburg, PA (US); John Mark Myer, Millersville, PA (US); John Raymond Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/120,313

(22) Filed: Apr. 10, 2002

(65) Prior Publication Data

US 2003/0194888 A1 Oct. 16, 2003

(51) Int. Cl.[7] ..... H01R 12/00
(52) U.S. Cl. ..... 439/79; 439/276; 439/541.5
(58) Field of Search ..... 439/79, 540.1, 439/541.5, 86, 89, 190, 191, 230, 466, 468, 604, 605, 606, 933, 936, 276

(56) References Cited

U.S. PATENT DOCUMENTS 5,354,210 A * 10/1994 Koblitz et al. ..... 439/276
5,429,697 A * 7/1995 Lilienthal et al. ..... 156/244.19
5,453,016 A * 9/1995 Clark et al. ..... 439/79
5,639,250 A * 6/1997 Neef et al. ..... 439/79
5,785,537 A * 7/1998 Donahue et al. ..... 439/79
6,183,270 B1 * 2/2001 Huang et al. ..... 439/79
6,200,161 B1 * 3/2001 McClinton et al. ..... 439/541.5
6,257,924 B1 * 7/2001 Lund et al. ..... 439/541.5
6,302,710 B1 * 10/2001 Wang et al. ..... 439/79
6,405,139 B1 * 6/2002 Kicinski et al. ..... 702/33

* cited by examiner

*Primary Examiner*—Gary Paumen
*Assistant Examiner*—Edwin A. Leon

(57) ABSTRACT

An electrical connector assembly is provided including contacts with front portions, intermediate portions, and rear portions. The intermediate portions are bent so that the front portions are aligned at an angle to the rear portions. The electrical connector assembly includes a first housing having a rear wall, through which the front portions of the contacts extend. The electrical connector assembly includes a second housing having a base that receives the rear portions of the contacts. At least one of the first and second housings form a pocket containing the intermediate portions of the contacts. The electrical connector assembly includes an encapsulate liquid placed into the pocket that hardens to hermetically seal the intermediate portions of the contacts.

28 Claims, 7 Drawing Sheets

SEALED ELECTRICAL CONNECTOR FOR RIGHT ANGLE CONTACTS

BACKGROUND OF THE INVENTION

Certain embodiments of the present invention generally relate to a right angle connector assembly that electrically connects electronic components. More particularly, certain embodiments of the present invention relate to a sealed electric connector assembly that electrically connects perpendicularly aligned electronic components.

In certain applications, such as in an automobile, electronic components that are perpendicularly aligned with each other and separated by a firewall are connected to each other through the firewall by an electric connector assembly. The electric connector assembly includes pin contacts within a housing. Each pin contact is bent at an intermediate portion so that a front portion is perpendicular to a rear portion. The pin contacts are positioned in the housing so that the front portions are connected to a mating jack within the interior of the automobile and the rear portions are connected to a printed circuit board within an engine space. The housing does not enclose the intermediate portions; therefore, the intermediate portions extend outward from the housing exposed to the dirt, heat, and stress created in the engine space environment unless protected by a cover.

In conventional electric connector assemblies, in order to protect the exposed intermediate portions of the pin contacts from the engine space environment, the intermediate portions are either over molded or injection molded with the housing or are encased by a plastic cover piece that fits over the housing. The process of over molding the bent intermediate portions of the pin contacts within a single housing is expensive and time-consuming because so many small and separate pin contacts are difficult to fully cover. The cover pieces are bulky, so the electric connector assembly may not be used in certain alignments where the cover piece interferes with surrounding components, thus limiting the versatility of the electric connector assembly. Therefore, a need exists for an electrical connector assembly for perpendicular electronic components that seals the pin contacts within the assembly without use of a molding process or a module cover.

BRIEF SUMMARY OF THE INVENTION

Certain embodiments of the present invention include an electrical connector assembly having contacts with front portions, intermediate portions, and rear portions. The intermediate portions are bent so that the front portions are aligned at an angle to the rear portions. The electrical connector assembly includes a first housing having a rear wall, through which the front portions of the contacts extend. The electrical connector assembly includes a second housing having a base that receives the rear portions of the contacts. At least one of the first and second housings form a pocket containing the intermediate portions of the contacts. The electrical connector assembly includes an encapsulate liquid placed into the pocket that hardens to hermetically seal the intermediate portions of the contacts.

Figure 1:
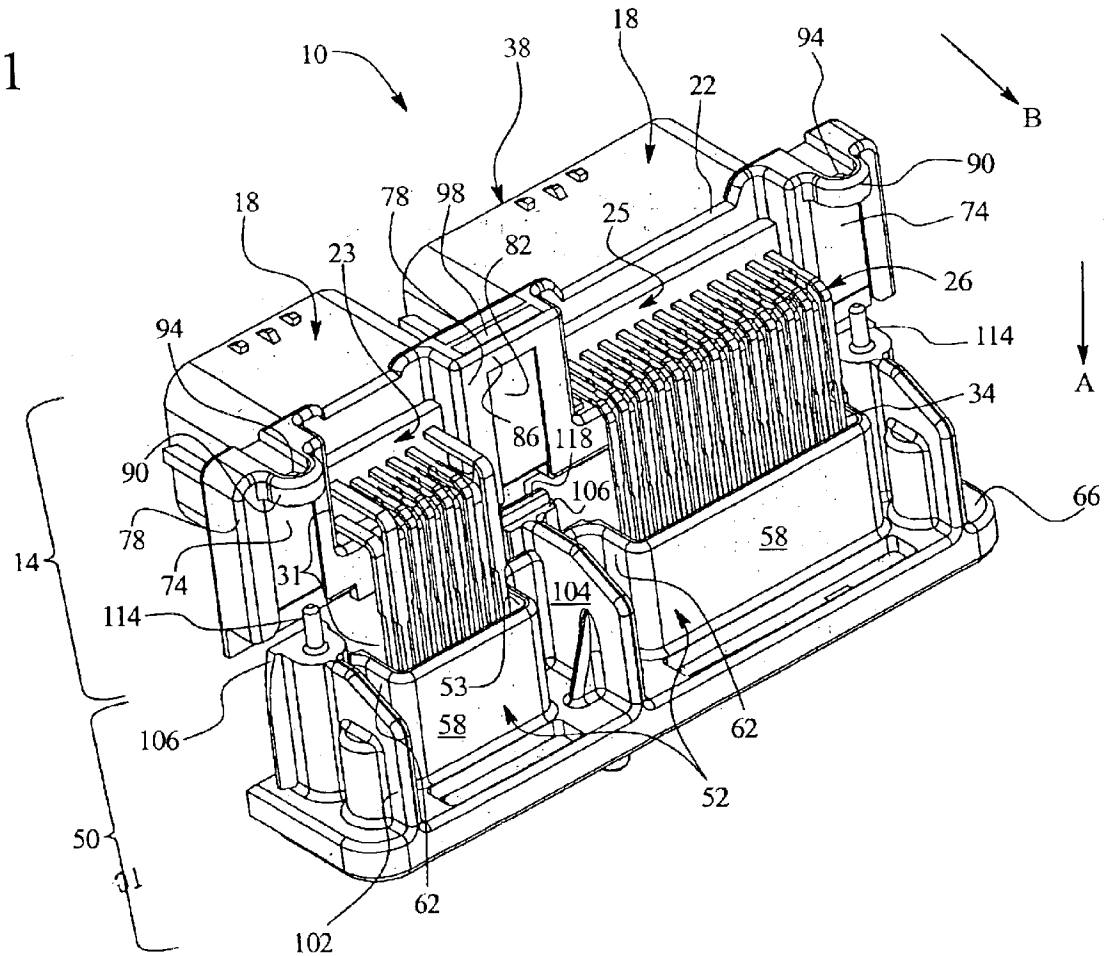
FIG. 1 illustrates an exploded rear isometric view of an electrical connector assembly according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an exploded rear isometric view of an electrical connector assembly 10. The electrical connector assembly 10 includes a shroud housing 14 having shroud cases 18 extending from a rear wall 22. The shroud cases 18 include open front sides 38 and surround pin contacts 26 extending through, and retained in, the rear wall 22. The pin contacts 26 have front portions 30 (FIG. 3), intermediate portions 31 and rear portions 34. During assembly, the pin contacts 26 are initially stamped integral with a carrier strip (not shown) in an unbent state. The carrier strip is used to align the pin contacts 26 with contact apertures 200 (FIG. 2) in the rear wall 22. The carrier strip is then cut off of the pin contacts 26, and the pin contacts 26 are loaded into the shroud cases 18 from the front side 38 rearward through the rear wall 22 in the direction of arrow B. The pin contacts 26 are located such that the front portions 30 are partially positioned within the shroud cases 18 and partially extend through the rear wall 22. The pin contacts 26 are then bent downward at the intermediate portions 31 in the direction of arrow A until the rear portions 34 are aligned perpendicular to the front portions 30. Once bent, the rear portions 34 of the pin contacts 26 are oriented to be inserted in a pin housing 50.

The pin housing 50 includes contact chambers 52 defined by rear walls 58 and opposite side walls 62 that extend upward from a rectangular base 66 and include open upper faces 53 that receive the pin contacts 26. The pin housing 50 and the shroud housing 14 are connected to each other by a tongue and groove system that includes side and center channels 74 and 82 receiving tongue walls 106. The side channels 74 are located on opposite ends of the rear wall 22 of the shroud housing 14, while the center channel 82 is located approximately in the center of the rear wall 22 between first and second pin arrays 23 and 25 of pin contacts 26. The center channel 82 and side channels 74 are defined by the rear wall 22 and flanged walls 78. Retention rings 90 extend from the rear wall 22 above the side channels 74 and define post holes 94 aligned with the side channels 74. The center channel 82 includes a wedge slot 98 enclosed by a channel strip 86 connecting the flanged walls 78. The wedge slot 98 is aligned with the center channel 82.

The pin housing 50 includes side flanges 102 and a center flange 104 that extend perpendicularly away from, and are oriented transverse to, the base 66. The side flanges 102 and center flange 104 include the tongue walls 106. The tongue walls 106 are oriented perpendicular to the side and center flanges 102 and 104 to form a T-shape. The tongue walls 106 extend along a plane that extends parallel to a length of the base 66. Cylindrical retention posts 114 extend upward from the side flanges 102 proximate the point at which the side flanges 102 and tongue wall 106 intersect, while a rectangular retention wedge 118 extends upward from the center flange 104 proximate the point at which the center flange 104 and tongue wall 106 intersect.

During assembly, the shroud housing 14 is moved downward in the direction of arrow A onto the pin housing 50 such that the center channel 82 and the side channels 74 slidably receive the tongue walls 106 on the center flange 104 and the side flanges 102, respectively. The tongue walls 106 are retained within the flanged walls 78 of the center channel 82 and the side channels 74. Additionally, the retention posts 114 and the retention wedge 118 are received and retained within the post holes 94 and the wedge slot 98, respectively. The retention posts 114 and the retention rings 90 are heat staked together to hold the shroud housing 14 and pin housing 50 firmly joined with one another.

Figure 3:
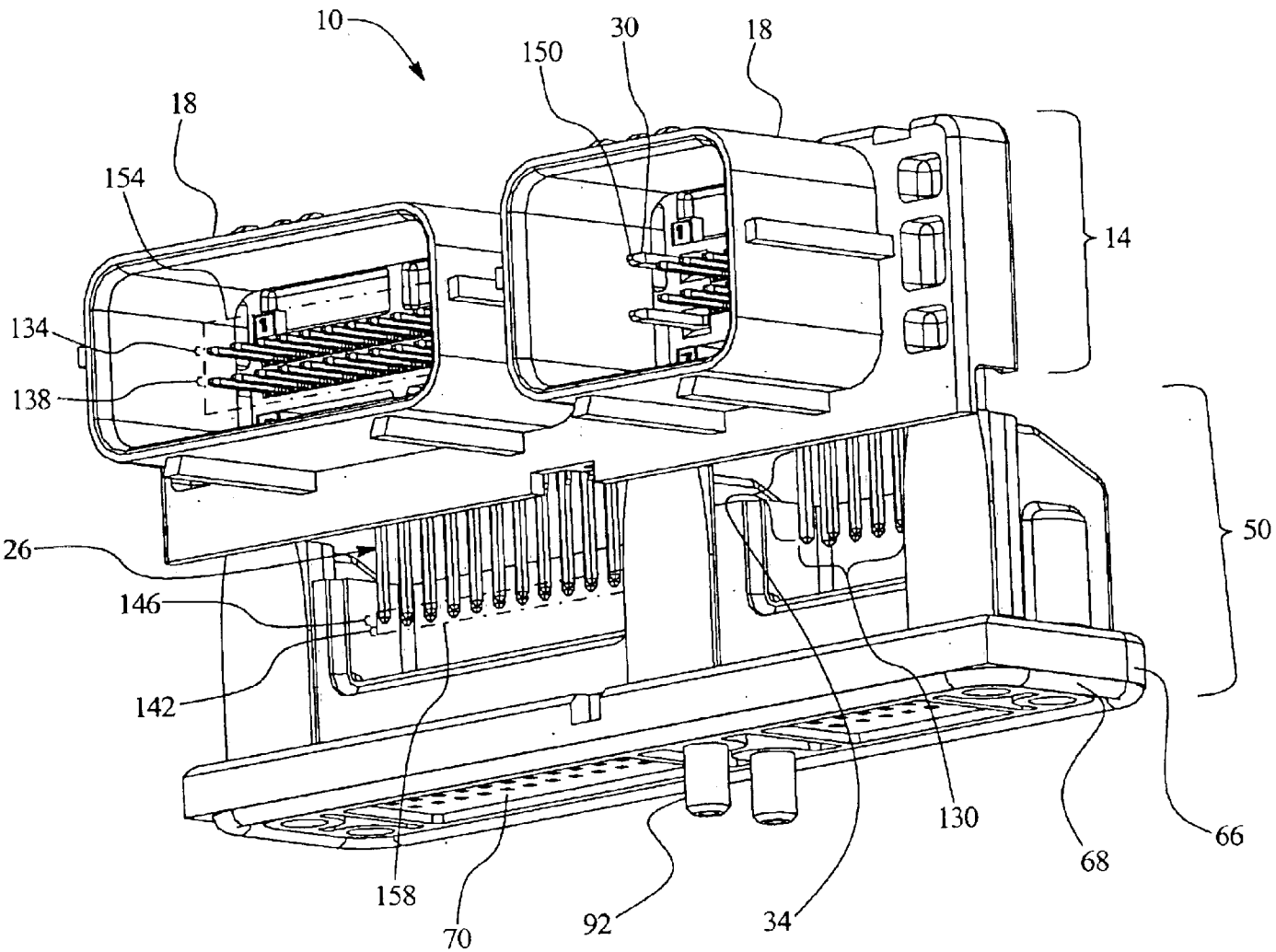
FIG. 3 illustrates an exploded front isometric view of the electrical connector assembly of FIG. 1.
Figure 4:
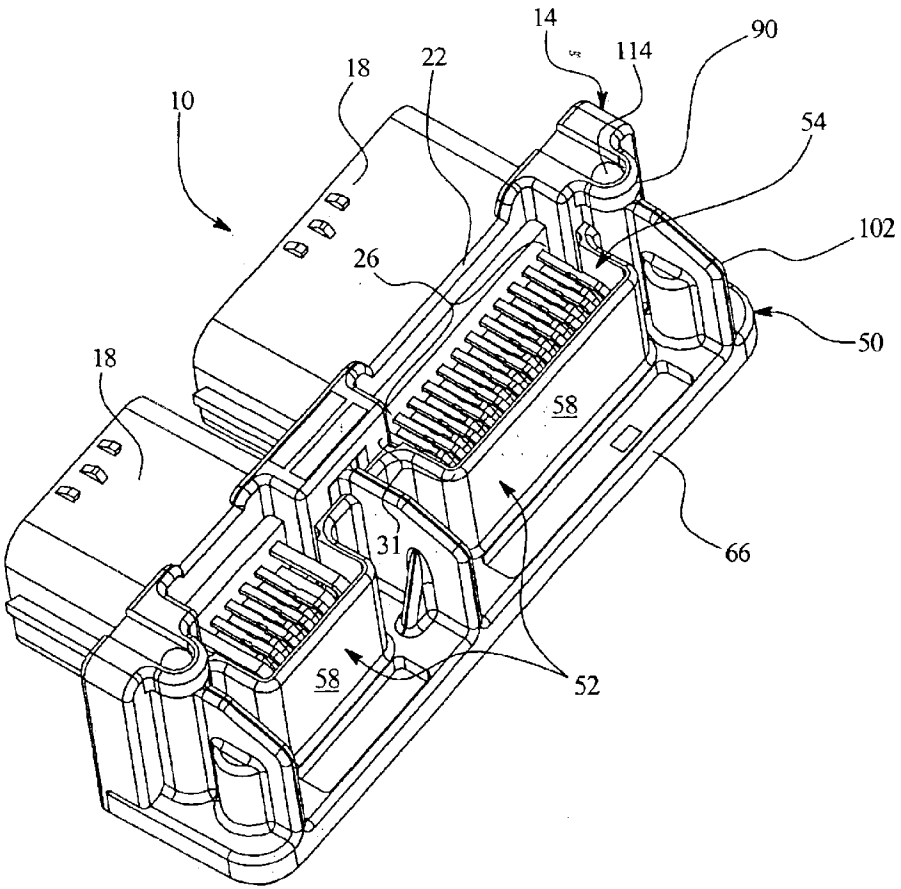
FIG. 4 illustrates a top isometric view of the electric connector assembly of FIG. 1 at an intermediate stage during assembly.

As shown in FIG. 4, as the shroud and pin housings 14 and 50 are joined, the rear wall 22 of the shroud housing 14 is aligned opposite to the rear walls 58 of the contact chambers 52 to form the fourth side of contact pockets 54. As the shroud and pin housings 14 and 50 are joined, the rear portions 34 (FIG. 1) of the pin contacts 26 pass through apertures 70 (FIG. 3) in the base 66 until tail ends 130 (FIG. 5) of the pin contacts 26 are exposed under the base 66. The tail ends 130 are later joined with a circuit board or other component.

Figure 2:
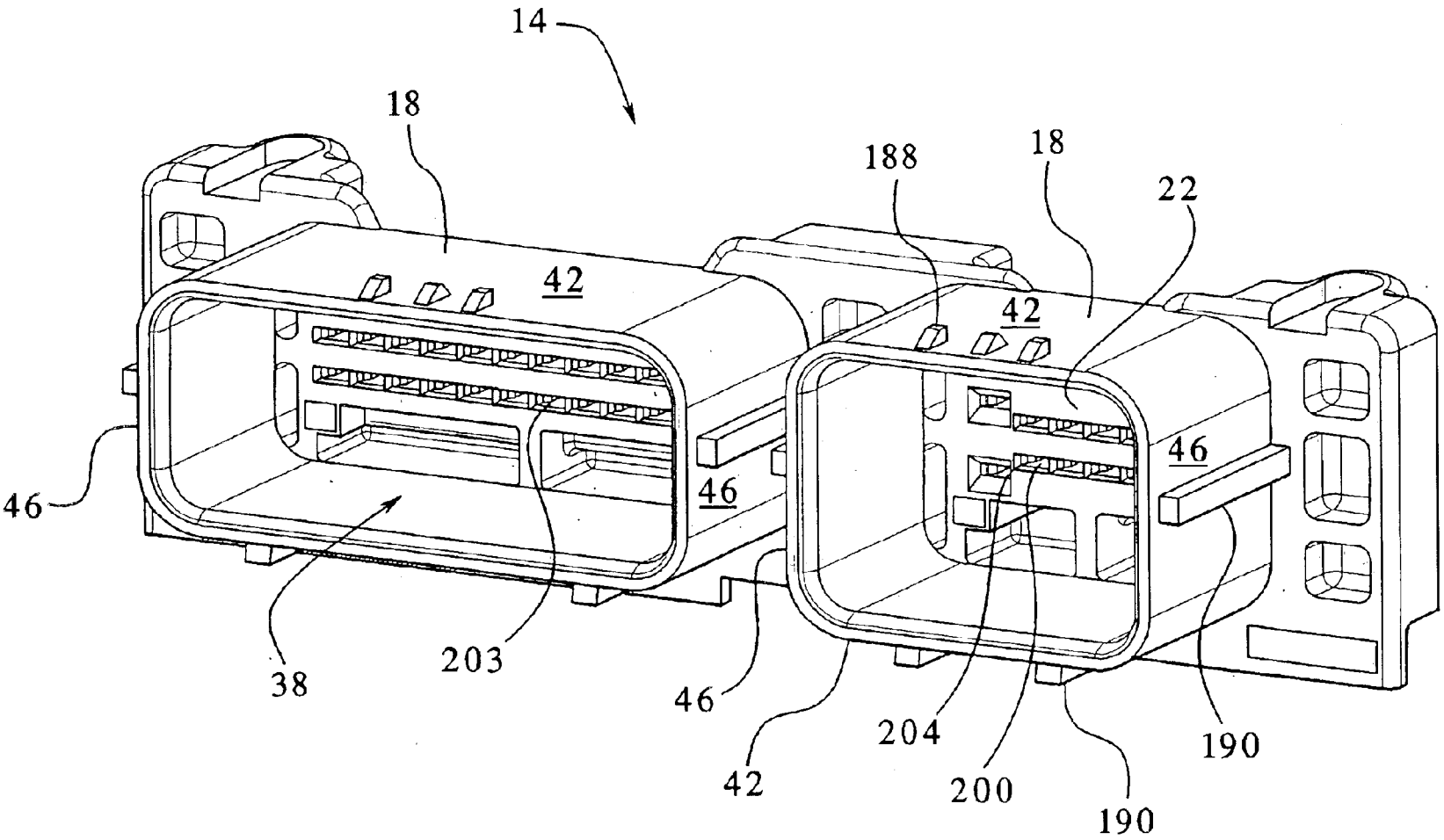
FIG. 2 illustrates a front isometric view of a shroud housing according to an embodiment of the present invention.

FIG. 2 illustrates a front isometric view of the shroud housing 14 with the pin contacts 26 removed. The rear wall 22 includes contact apertures 200 within the shroud cases 18. The pin contacts 26 (FIG. 1) are inserted into the shroud housing 14 in the direction of arrow B through the front sides 38 and through the contact apertures 200. Retention notches 203 are provided within the contact apertures 200 to resist and frictionally retain the pin contacts 26 once positioned within the rear wall 22 with the front portions 30 (FIG. 3) suspended within the shroud cases 18.

The shroud cases 18 are defined by opposite side walls 42 and opposite end walls 46. The side walls 42 include wedge shaped jack catches 188 extending outward from the exterior thereof. The end walls 46 include key strips 190 extending outward from the exteriors thereof. Once connected to a mating jack (not shown), the shroud cases 18 are enclosed by the mating jack which contains female contacts that are matable with the front portions 30 (FIG. 3) of the pin contacts 26 exposed within the shroud cases 18. The mating jack has walls with features that slidably enclose the key strips 190 to orient the mating jack with the shroud cases 18. The walls of the mating jack also have features that snapably engage the jack catches 188, thus retaining the mating jack about the shroud cases 18 with the pin contacts 26 (FIG. 1) mated with corresponding female contacts.

FIG. 3 illustrates an exploded front isometric view of the electrical connector assembly 10 of FIG. 1. Cylindrical alignment posts 92 extend downward from beneath the base 66 in order to align the pin housing 50 with, a printed circuit board or other component (not shown). The base 66 also includes a flexible base ring 68 that sealably engages the printed circuit board to prevent contaminants from coming between the base 66 and the printed circuit board. When the shroud housing 14 is fully mounted to the pin housing 50, the base 66 receives and retains the rear portions 34 of the pin contacts 26 in apertures 70.

The front portions 30 of the pin contacts 26 are aligned in first and second rows 134 and 138 within the shroud cases 18. Similarly, the rear portions 34 of the pin contacts 26 are aligned in first and second rows 142 and 146. The pin contacts 26 of the first rows 134 and 142 are longer than the pin contacts 26 of the second rows 138 and 146. Front ends 150 of the pin contacts 26 of the first and second rows 134 and 138 are aligned along a vertical plane 154 and the tail ends 130 of the pin contacts 26 of the first and second rows 142 and 146 are aligned along a horizontal plane 158. The shroud cases 18 receive and retain the mating jack (not shown) that includes female contacts aligned in rows that correspond to the first and second rows 134 and 138 of the front portions 30 and that electrically communicate with the front portions 30. Also, when the rear portions 34 are fully inserted into the pin housing 50 through the apertures 70, the tail ends 130 may be soldered to the printed circuit board (not shown), which is perpendicular to the mating jacks.

FIG. 4 illustrates a top isometric view of the electric connector assembly 10 of FIG. 1 in which the shroud housing 14 and the pin housing 50 are fully mounted to each other. The open sides of the contact pockets 54 are enclosed by the rear wall 22. The contact pockets 54 retain the intermediate portions 31 of the pin contacts 26, while the tail ends 130 (FIG. 5) extend through the base 66 and the front ends 150 (FIG. 3) are positioned within the shroud cases 18. The retention posts 114 of the side flanges 102 are heat staked to the retention rings 90 to prevent the shroud housing 14 from being disengaged from the pin housing 50. An encapsulate material is then poured into the contact pockets 54, covering and surrounding the pin contacts 26 and sealing the contact pockets 54 from the external environment.

Figure 5:
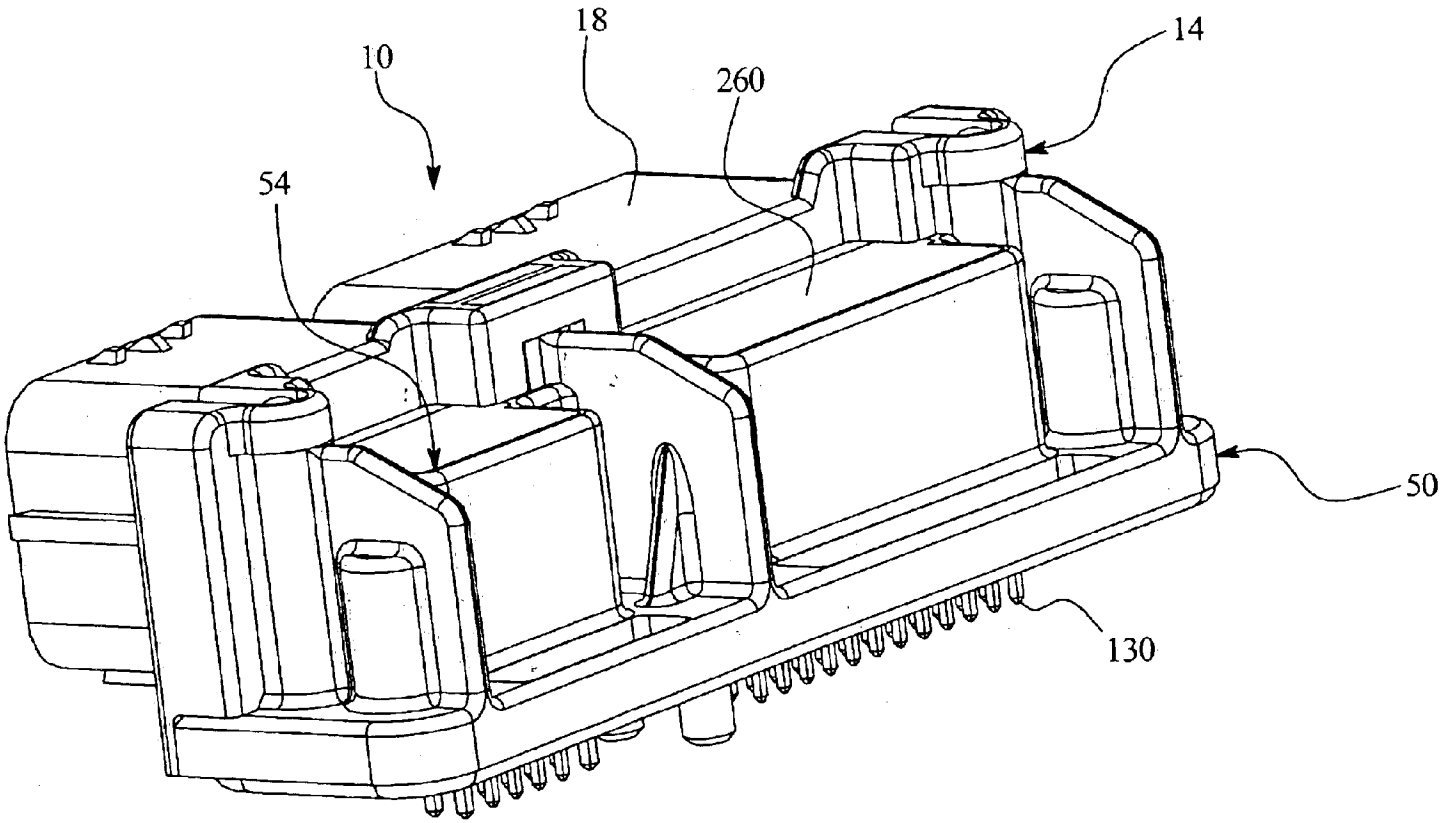
FIG. 5 illustrates a rear isometric view of the electric connector assembly of FIG. 1 after final assembly.

FIG. 5 illustrates a rear isometric view of the electric connector assembly 10 of FIG. 1. An encapsulate 260 fills the contact pockets 54 and hardens to cover and hermetically seal the intermediate portions 31 (FIG. 4) of the pin contacts 26. The encapsulate 260 protects the intermediate portions 31 of the pin contacts 26 from heat, destruction, or contamination from external sources. The encapsulate 260 may be an epoxy or a silicone based material or other material. Depending on the consistency of the encapsulate 260 before it hardens, the encapsulate 260 is poured or packed into the contact pockets 54 so that the intermediate contacts 31 are completely covered by the encapsulate 260 in its viscous state. Besides protecting the pin contacts 26, the encapsulate 260 may also serve to bond the pin housing 50 to the shroud housing 14. In operation, the tail ends 130 are soldered to the printed circuit board and the shroud cases 18 receive the mating jacks. Thus, the electric connector housing 10 delivers electric signals between the perpendicularly aligned printed circuit board and mating jacks without risk of the pin contacts 26 being damaged.

Figure 6:
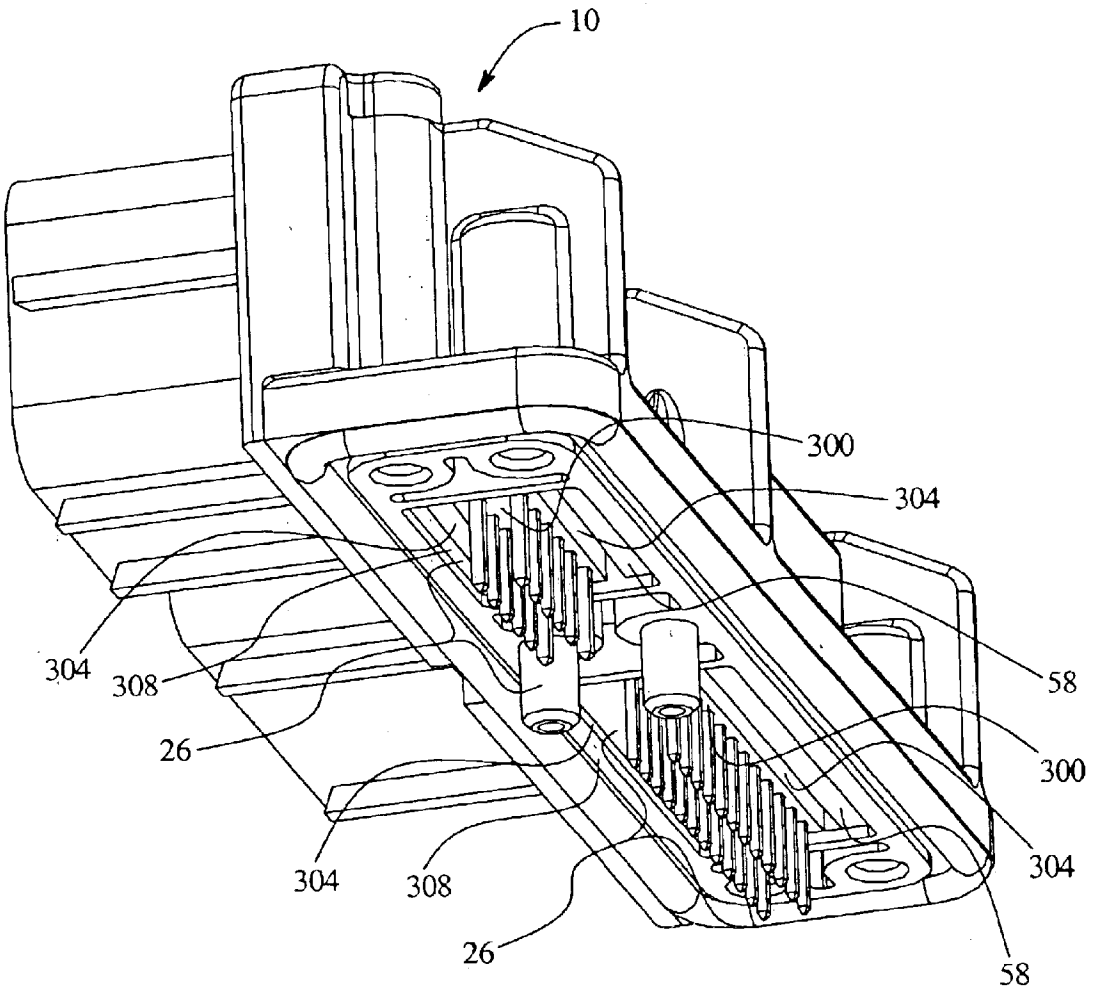
FIG. 6 illustrates a bottom isometric view of the electric connector assembly formed in accordance with an embodiment of the present invention.

FIG. 6 illustrates a bottom isometric view of the electric connector assembly 10 formed in accordance with an embodiment of the present invention. The pin contacts 26 are retained within core walls 300 that extend from the contact chambers 52 (FIG. 1). Air pockets 304 extend between the core walls 300 and the rear walls 58 of the contact chambers 52 and between the core walls 300 and front walls 308 of the contact chambers 52.

Figure 7:
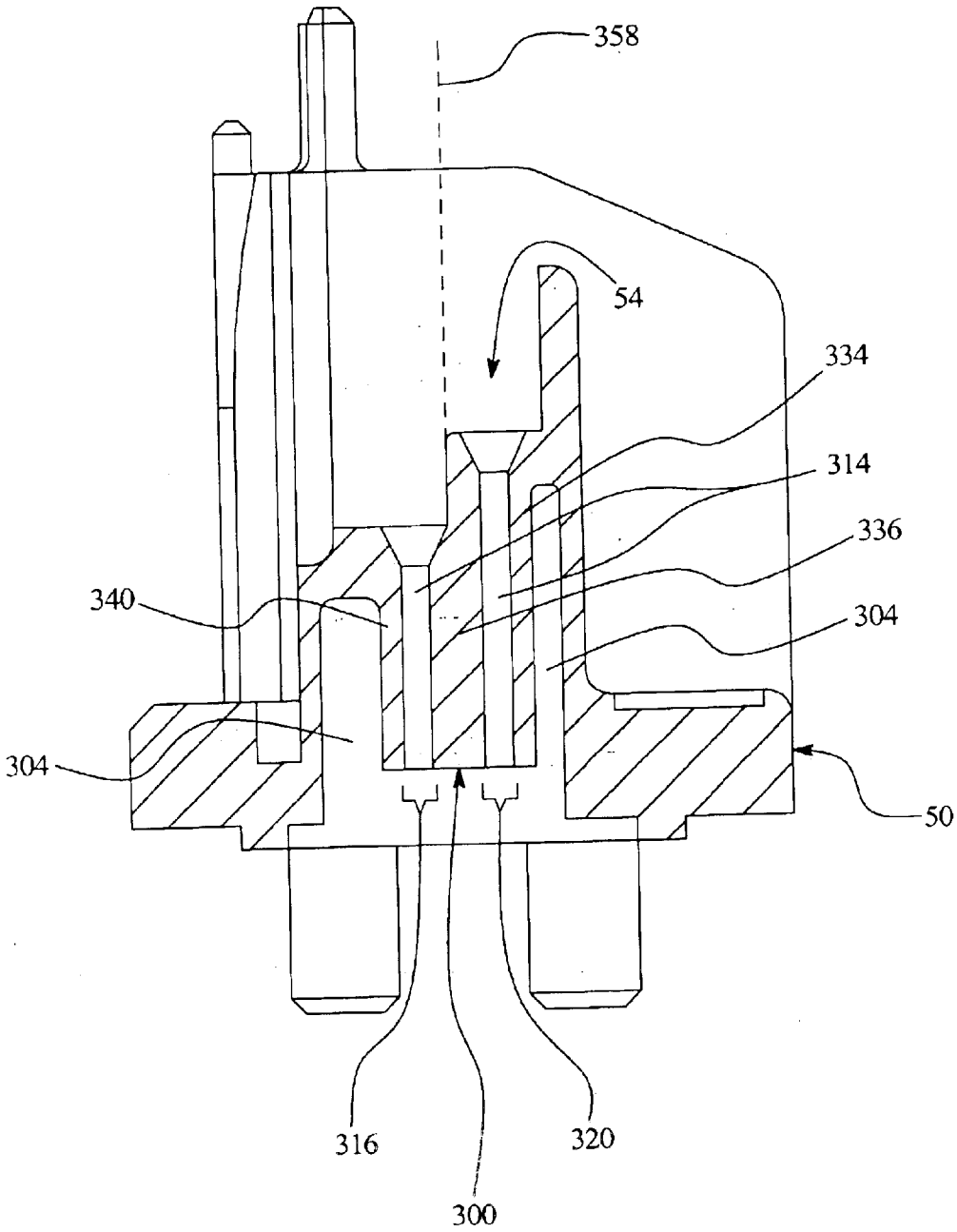
FIG. 7 illustrates a cutaway side view of the pin housing formed in accordance with an embodiment of the present invention.

As shown in the cutaway side view of the pin housing 50 in FIG. 7, the core walls 300 have contact slots 314 aligned in first and second slot rows 316 and 320. The contact slots 314 have reception basins 324 to receive the pin contacts 26. The first slot row 316 is situated between center sections 336 and first sections 340 of the core walls 300. The second slot row 320 is situated between the center sections 336 and second sections 344 of the core walls 300. The contacts slots 314 in the second slot row 320 are longer than the contact slots 314 in the first slot row 316 because the second sections 344 and the center sections 336 are raised higher along a vertical axis 358 than the first sections 340. Thus, the second sections 344 and the center sections 336 take up more space within the contact pockets 54.

In operation, when the shroud housing 14 (FIG. 1) is fully connected to the pin housing 50 such that the pin contacts 26 (FIG. 1) extend through the core walls 300 and the encapsulate 260 (FIG. 5) is placed in the contact pockets 54, the air pockets 304 and the raised center and second sections 336 and 344 allow the pin contacts 26 to be soldered to a printed circuit board by use of a convection oven. As the electric connector assemblies 10 (FIG. 4) are conveyed through the convection oven, the encapsulate 260 absorbs the heat and the plastic pin housing 50 insulates the pin contacts 26. Thus, the air pockets 304 deliver enough heat around the insulating core walls 300 to solder the pin contacts 26 to the printed circuit boards. The larger the air pocket 304 and the closer the proximity of the air pocket 304 to the pin contacts 26, the greater the heat delivered to solder the pin contacts 26 to the printed circuit board.

Additionally, the raised center and second sections 336 and 344 take up more space within the contact pockets 54, so less encapsulate 260 is placed within the contact pockets 54 to secure the pin contacts 26. Thus, less heat is absorbed by the encapsulate 260, enabling more heat to reach the pin contacts 26 and thus increase the speed and the efficiency of soldering the pin contacts 26 to the printed circuit boards.

Alternatively, the first and second sections 340 and 344 may be removed from the core walls 300 such that the pin contacts 26 are exposed to an air pocket 304 on one side and the center sections 336 on the other side. In yet another embodiment the core walls 300 may be removed such that the pin contacts 26 are completely exposed to the air pockets 304.

The electric connector assembly confers a number of benefits. The assembly utilizes two connectable housings, that, when fully assembled with the pin contacts, form contact pockets that entirely enclose the exposed intermediate portions of the pin contacts. Instead of over molding or injection molding the entire assembly to protect the pin contacts, the encapsulate is poured into the contact pocket and covers the pin contacts. Also, the encapsulate cover takes up a limited amount of space so that the electric connector assembly may be used in a number of different arrangements. Further, by retaining the pin contacts within a core wall surrounded by air pockets, the pin contacts receive enough heat to be soldered to a printed circuit board.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly, comprising:

contacts having front portions, intermediate portions, and rear portions;

a first housing having a shroud mounted to a rear wall, said rear wall including first contact apertures extending therethrough, said first contact apertures retaining said front portions of said contacts within said shroud of said housing;

a second housing having a base, a rear wall and side walls extending upwardly from said base, said rear wall and said side walls defining a chamber having an open upper face, said base including second contact apertures extending downwardly therethrough; and said first housing being installed downwardly onto said second housing wherein said rear portions of said contacts are moved through said chamber and through said second contact apertures and are exposed below said base, and said intermediate portions of said contacts are received in said chamber, said chamber defining a pocket for an encapsulate material which is received through said open upper face, said encapsulate material encasing said intermediate portions of said contacts.

2. The electrical connector assembly of claim 1, wherein said base has a core wall retaining said contacts and surrounded by air pockets, said air pockets receiving and retaining air about said contacts.

3. The electrical connector assembly of claim 1, wherein said base includes a core wall having an elevated portion and a lower portion, said elevated portion reducing the amount of said encapsulate material provided in said pocket.

4. The electrical connector assembly of claim 1, wherein said rear wall of said first housing cooperates with said rear wall and said side walls of said second housing to define said pocket.

5. The electrical connector assembly of claim 1, wherein said intermediate portions of said contacts are bent such that said front portions are oriented generally perpendicular to said rear portions.

6. The electrical connector assembly of claim 1, wherein said rear wall of said first housing retains said front portions of said contacts in a first row aligned along a first plane, said base of said second housing retaining said rear portions of said contacts in a second row aligned along a second plane, said first plane being generally perpendicular to said second plane.

7. The electrical connector assembly of claim 1, wherein said rear portions include tail ends extending through said base of said second housing and being configured to be connected to a printed circuit board.

8. The electrical connector assembly of claim 1, wherein said first contact apertures include notches that frictionally engage and retain said front portions of said contacts in said rear wall suspended within said shroud.

9. The electrical connector assembly of claim 1, wherein said second housing includes flanges having tongues extending upward from said base and said rear wall includes grooves, said grooves slidably receiving said tongues when said first and second housings are joined.

10. The electrical connector assembly of claim 1, wherein said second housing includes flanges having posts and said first housing includes a top wall having apertures, said apertures slidably receiving and retaining said posts.

11. The electrical connector assembly of claim 1, wherein said contacts are releasably joined to a carrier strip during assembly, said carrier strip guiding said contacts to said contact apertures of said first housing.

12. The electrical connector assembly of claim 1, wherein said encapsulate material secures said contacts within at least one of said chamber and said shroud.

13. An electrical connector assembly, comprising:

contacts having front portions, intermediate portions, and rear portions, said intermediate portions being bent so that said front portions are aligned at an angle to said rear portions;

a first housing having a rear wall, through which said front portions of said contacts extend, said rear wall retaining said contacts;

a second housing having a base receiving and retaining said rear portions of said contacts with said rear portions extending below and exposed from said base, at least one of said first and second housings forming a pocket surrounding said intermediate portions of said contacts, said pocket including an open upper face opposite said base; and an encapsulate liquid placed into said pocket through said upper face and hardening to hermetically seal said intermediate portions of said contacts.

14. The electrical connector assembly of claim 13, wherein said rear wall retains said front portions of said contacts in a first row aligned along a first plane, said base retains said rear portions of said contacts in a second row aligned along a second plane, said first plane being generally perpendicular to said second plane.

15. The electrical connector assembly of claim 13, wherein said rear portions include tail ends extending through said base and configured to be connected to a printed circuit board.

16. The electrical connector assembly of claim 13, wherein said rear wall includes notches that frictionally engage and retain said front portions of said contacts in said rear wall suspended within said shroud.

17. The electrical connector assembly of claim 13, wherein said pocket has an end wall and opposite side walls extending from said base, and an open side opposite said end wall.

18. The electrical connector assembly of claim 13, wherein said second housing includes flanges having tongues extending upward from said base and said rear wall includes grooves, said grooves slidably receiving said tongues when said first and second housings are joined.

19. The electrical connector assembly of claim 13, wherein said second housing includes flanges having posts and said first housing includes a top wall having apertures, said apertures slidably receiving and retaining said posts.

20. The electrical connector assembly of claim 13, wherein said contacts are releasably joined to a carrier strip during assembly, said carrier strip guiding said contacts to said contact apertures of said first housing.

21. The electrical connector assembly of claim 13, wherein said encapsulate liquid secures said rear wall to said pocket and encloses said pocket.

22. The electrical connector assembly of claim 13, wherein said encapsulate liquid secures said contacts within said pocket.

23. A method of forming an electrical connector assembly, comprising:

inserting contacts through apertures in a first housing from a front side of said first housing until front portions of the contacts extend from said front side of the first housing and intermediate and rear portions of the contacts extend from and are exposed through a rear side of the first housing;

inserting the rear portions of the contacts through apertures in a second housing such that the rear portions of the contacts are retained in the second housing;

combining the first and second housings to form a pocket having an open upper face, said pocket surrounding the intermediate portions of the contacts with the rear contacts extending below and exposed from the second housing; and introducing a liquid material into the pocket through said upper face and permitting the liquid material to harden thereby hermetically encasing the intermediate portions of the contacts.

24. The method of claim 23, further comprising bending said contacts at said intermediate portions such that said front portions are oriented generally perpendicular to said rear portions.

25. The method of claim 23, further comprising connecting tail ends of said rear portions extending through said second housing to a printed circuit board.

26. The method of claim 23, further comprising engaging crossbars about said front portions with said apertures in said first housing as said contacts are inserted into said first housing such that said front portions of said contacts are retained in said first housing.

27. The method of claim 23, further comprising securing said rear side of said first housing to said second housing upon hardening of said liquid material.

28. The method of claim 23, further comprising slidably inserting tongues extending from flanges extending from a base of said second housing into grooves located in said rear side such that said first and second housings are joined.

* * * * *